US007306297B2

(12) United States Patent
Woody

(10) Patent No.: US 7,306,297 B2
(45) Date of Patent: Dec. 11, 2007

(54) PORTABLE NAIL SALON

(76) Inventor: Leatrice Deshawn Woody, 446 N. Wells St., Suite 358, Chicago, IL (US) 60610

( * ) Notice: Subject to any disclaimer, the term of this patent is extended or adjusted under 35 U.S.C. 154(b) by 850 days.

(21) Appl. No.: 10/625,744

(22) Filed: Jul. 23, 2003

(65) Prior Publication Data

US 2007/0085455 A1 Apr. 19, 2007

Related U.S. Application Data

(60) Provisional application No. 60/464,727, filed on Apr. 23, 2003.

(51) Int. Cl.
*A47B 97/00* (2006.01)

(52) U.S. Cl. ..... 312/249.8; 280/47.26

(58) Field of Classification Search ..... 312/249.8, 312/249.12, 249.13, 290, 209, 324, 327, 312/328; 280/47.26, 47.17, 47.19, 47.24, 280/47.34, 47.35; 190/11, 39; D6/432, 441, D6/443, 445, 491; D28/61
See application file for complete search history.

(56) References Cited

U.S. PATENT DOCUMENTS

| | | | | | |
|---|---|---|---|---|---|
| 42,943 | A * | 5/1864 | Hance | ..... | 211/76 |
| 747,741 | A * | 12/1903 | Marsh | ..... | 312/118 |
| 1,473,319 | A * | 11/1923 | Ray | ..... | 224/42.32 |
| 3,085,842 | A * | 4/1963 | Johnson | ..... | 312/209 |
| 3,784,270 | A * | 1/1974 | DeLapp | ..... | 312/236 |
| 4,329,002 | A * | 5/1982 | Cowen et al. | ..... | 312/196 |
| 4,344,660 | A * | 8/1982 | Molnar et al. | ..... | 312/249.13 |
| 4,432,112 | A * | 2/1984 | Muller et al. | ..... | 15/36 |
| 5,333,885 | A * | 8/1994 | Pullman | ..... | 280/47.19 |
| 5,405,587 | A * | 4/1995 | Fernandez et al. | ..... | 422/292 |
| 5,518,310 | A * | 5/1996 | Ellman et al. | ..... | 312/249.12 |
| 6,036,203 | A * | 3/2000 | Tyus et al. | ..... | 280/47.26 |
| D446,046 | S * | 8/2001 | Aeberhard | ..... | D6/433 |
| D484,724 | S * | 1/2004 | Rodon et al. | ..... | D6/559 |
| 6,820,879 | B1 * | 11/2004 | Butterfield | ..... | 280/47.26 |
| 7,188,844 | B2 * | 3/2007 | Hinds | ..... | 280/47.25 |
| 2001/0030403 | A1 * | 10/2001 | Johnson et al. | ..... | 280/47.26 |
| 2002/0130476 | A1 * | 9/2002 | Carter | ..... | 280/47.26 |

* cited by examiner

*Primary Examiner*—Janet M. Wilkens
(74) *Attorney, Agent, or Firm*—John S. Kendall, Esq.

(57) ABSTRACT

An apparatus for the safe storage and transport of nail technician implements. The invention comprises: a body having a rear panel, left and right sides and a base. A handle formed at the top and connected to the left and right sides. A cavity is defined by said rear panel, base, and said left and front sides, and upper and lower panels hingedly attached to said left and right sides.

7 Claims, 2 Drawing Sheets

PORTABLE NAIL SALON

CLAIM FOR PRIORITY OF INVENTION

This application claims the benefit of U.S. Provisional Application No. 60/464,727, Portable Nail Salon filed 23 Apr. 2003 presently co-pending in accordance with 35 USC § 119 (e).

FIELD OF THE INVENTION

This invention relates to the transport and storage of utensils for a nail salon. More particularly, to a portable system for the storage of the nail technicians implements and the prep and polish table necessary to allow for a complete hand and foot treatment.

BACKGROUND OF THE INVENTION

Fingernail polish has been, and will continue to be, a popular cosmetic staple. When applying fingernail polish it is desirable not only to have a stable surface to place one's hand for application of the polish, but also to have a means of securely storing and transporting fingernail polish and other implements associated with the treatment and conditioning of the hands and feet. Furthermore, it is desirable to have the fingernail polish bottle in a location that is close to the polish application area to prevent the need for over-reaching and, again, the possibility of tipping and/or spilling of the bottle. Moreover, it is a desirable convenience that both the surface for application and the means for securely holding the bottle are portable. Thus, allowing the user to apply fingernail polish at any opportune location.

Various patents have attempted to address these desires. For example, U.S. Pat. Nos. 5,743,500 and 5,909,811 describe bottle holders. Each of these bottle holders is provided with a single bottle holding container to which is attached flexible arms that may be draped over the arm or leg of the user, or laid flat upon a surface. Each of these bottle holders accommodates only a single bottle and neither provides a flat surface upon which a user may rest their hand for fingernail polish application. The '500 patent does provide a ring of "petals" upon which a user may place one finger at a time for application of polish, however, the finger must be raised without any support under the hand causing it to be unstable/movable during polish application. Further, if the "petals" are used, the fingernail is in very close proximity to the bottle making application of the polish difficult and awkward.

U.S. Pat. No. 5,913,312 describes a nail polish bottle holder that also provides an area for resting of the hand during application of the polish. The device described in the '312 patent is comprised of a flexible foam material incorporating a plurality of notches into which may be inserted one or more bottles. The fact that the '312 device is comprised of foam makes it rather unstable, e.g., bottles may be tipped and the user's hand is not rigidly supported, and less durable than something fabricated of a rigid material such as plastic.

In view of the above, there is a need in the art for a portable nail salon that is able to accommodate and store numerous types/shapes of nail polish bottles, that provides a stable surface for the hand or foot during application of the polish, that places the bottle in close proximity to the hand during application of the polish allowing for non-awkward application of the polish, that is easily transported, and that is durable in construction.

SUMMARY OF THE INVENTION

The present invention meets the requirements as stated above. The portable nail polish salon generally comprises a body portion having left and right sides. The sides joined together at the top forming a handle and at the rear. The left and right sides also define an inner cavity for storage. Shelves are deposed within the inner cavity dividing it into a plurality of compartments. Hinged panels are attached to the body portion closing the inner cavity and providing hand and foot rests.

In a preferred configuration, the side flaps are hingedly secured to the body portion allowing the portable nail polish salon to be configured between a usable configuration and a portable configuration. Further, in a preferred configuration, the base portion includes at least two, and more preferably three, nail polish bottle holding wells. Each of the holding wells are preferably of a different shape and/or size. The portable nail salon may additionally include a lamp that illuminates the substantially horizontal work surface area.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the invention comprises: a body having a rear panel, left and right sides and a base; a handle formed at the top of said left and right sides; a cavity defined by said rear panel, base, and said left and front sides; and upper and lower panels hingedly attached to said left and right sides Other features and advantages of the present invention will be apparent from the following description in which the preferred embodiments have been set forth and in conjunction with the accompanying drawings.

BRIEF DESCRIPTION OF THE DRAWINGS

The accompanying drawings, which are incorporated in and form part of the specification, illustrate an embodiment of the present invention and together with the description, serve to explain the principles of the invention. In the drawings.

DETAILED DESCRIPTION OF THE INVENTION

Figure 2:
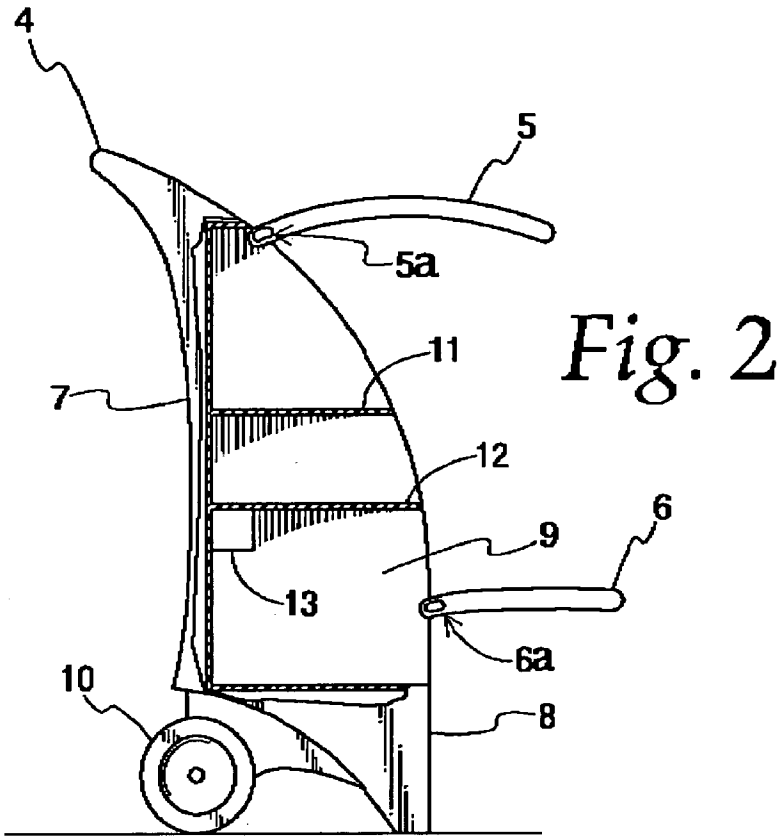
FIG. 2 shows the cutaway of the invention.
Figure 1:
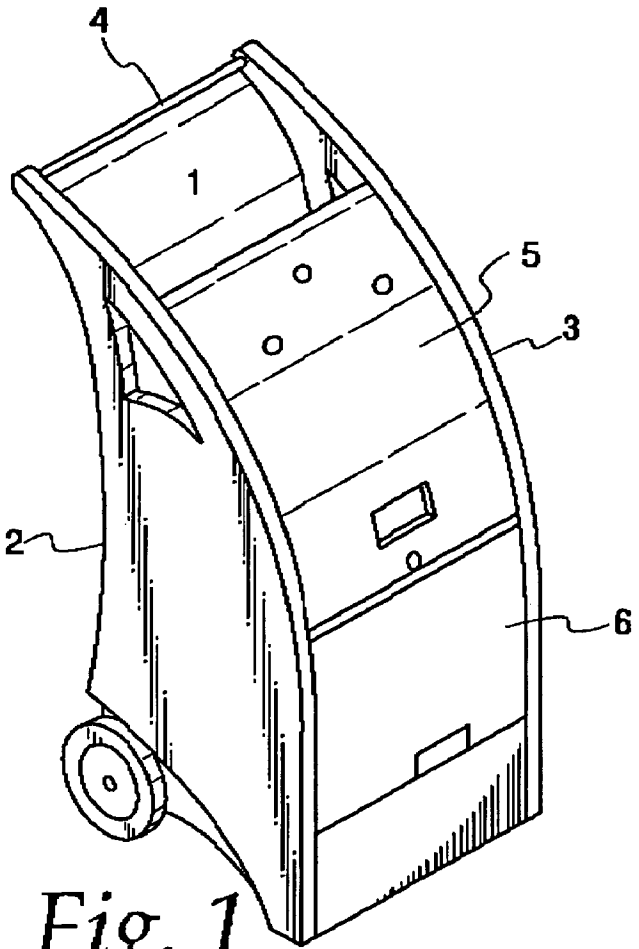
FIG. 1 shows the invention.

Referring to FIGS. 1 and 2, the portable nail salon (1) include side panels (2) and (3). A handle (4) is formed at the top of panels (2, and 3). Front panels (5 and 6) serve as locking doors and prep tables for the hands and feet. The front panels (5 and 6) raise to a perpendicular position to the back panel (7). Locking mechanism (5*a* and 6*a*) secure the front panels in the upright position. The locking mechanisms (5*s* and 8*a*) can be either a sliding lock or a hidden hinge. The back panel (7) and base (8) form a hollow inner cavity (9). Wheels (10) are fitted at the bottom of the base (8) and back panel (7). Shelves (11 and 12) are deposed within the inner cavity (9). An illuminating device (13) is located within the inner cavity (9). The illuminating device can be either an incandescent, black light, or fluorescent lighting device.

Figure 4:
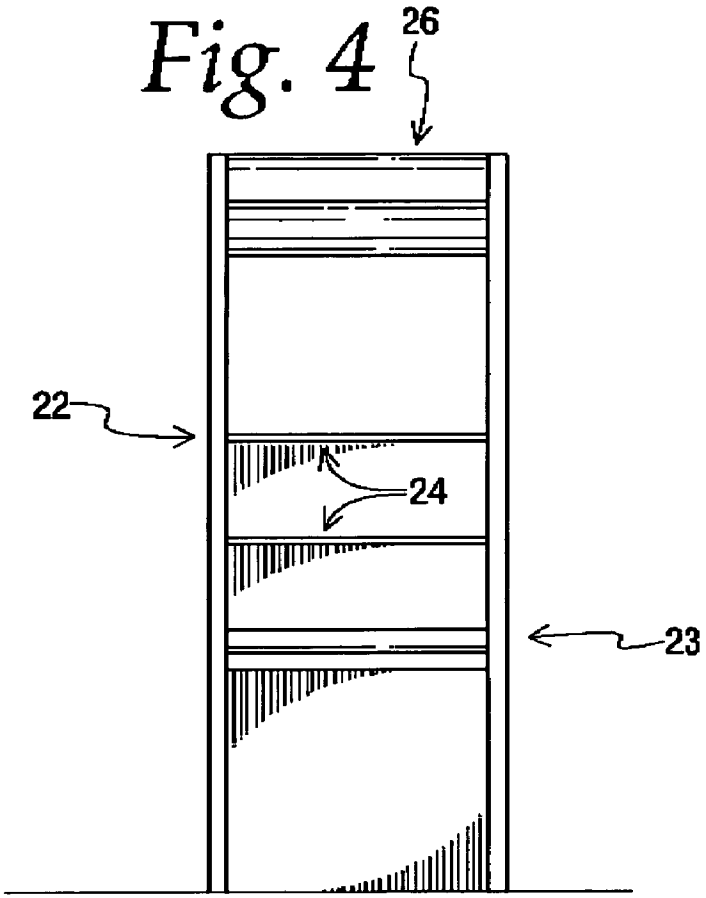
FIG. 4 shows a front view of the invention in the closed position.
Figure 3:
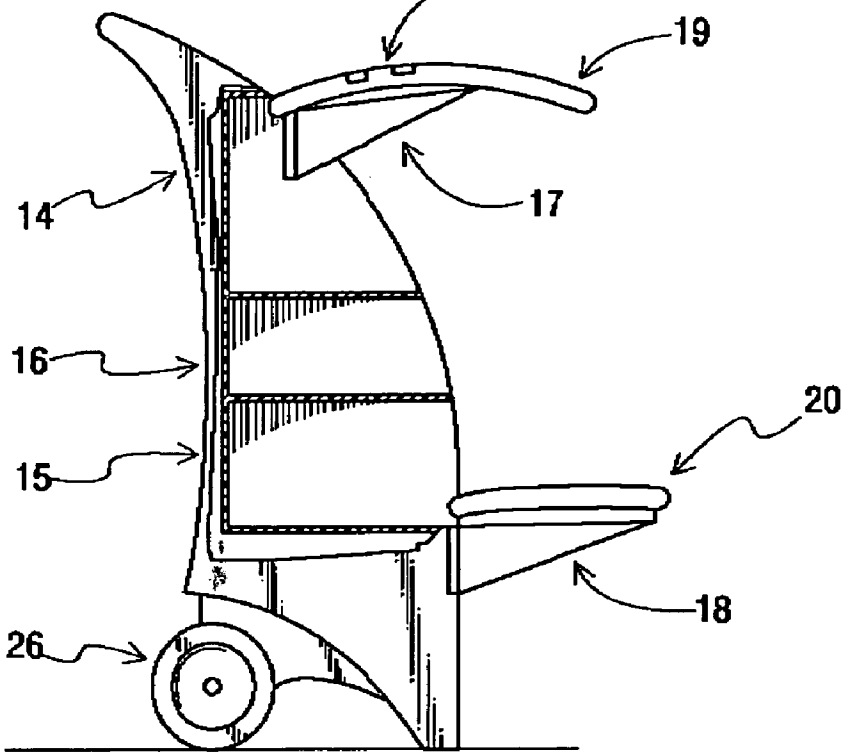
FIG. 3 shows a side view of the invention in an open position.

Referring to FIGS. 3, and 4, in the preferred embodiment the portable nail salon (14) has a sleek and compact design. The back panel (15) has a distinctive ergonomic curve (16) allowing the user to move the invention in almost an upright position. The crescent moon shape of the side panels (22 and 23) allows both the technician and client to sit close to the nail salon. Panels (19 and 20) further include a plurality of indentations (21) that are adapted to secure the nail implements. Additionally, with the front panels (19 and 20) in the upright position the client can rest either hand or foot on the panels in a comfortable and relaxed position. Brackets (17 and 18) allow the panels (19 and 20) lock in the upright position. Shelves (24) are attached to side panels (22 and 23) provide secure storage of lotions polishes and accessories. The side panels (22 and 23) are joined at the top by member (25) to form a handle. Moreover, the technician can also comfortably work on either the hands or feet.

The foregoing description of the preferred embodiment of the invention has been presented for purposes of illustration and description. It is not intended to be exhaustive or to limit the invention to the precise form disclosed, and obviously many modifications and variations are possible in light of the above teaching.

The embodiments of the invention in which an exclusive property or privilege is claimed are defined as follows:

1. A portable nail salon comprising:

a body having an ergonomic curved rear panel attached to corresponding crescentric left and right sides:

a base adjacently connected to the rear panel, and said left and right sides forming an inner cavity;

a handle extending between the top of the left and right sides; and curvilinear upper and lower panels hingably attached to said left and right sides in congruent agreement, in a closed position to enclose the inner cavity.

2. The portable nail salon as recited in claim 1 wherein said upper and lower panels have a hinge arrangement allowing said upper and lower panels to be raised and locked in a position substantially perpendicular to the nail salon.

3. The portable nail salon as recited in claim 2 wherein said inner cavity further comprises at least two shelves deposed within said inner cavity and attached to said left and right sides.

4. The portable nail salon as recited in claim 3 wherein said upper and lower panels further comprise a plurality of indentations adapted to secure nail implements.

5. The portable nail salon as recited in claim 4 wherein said inner cavity further comprises an illuminating device attached to said rear panel.

6. The portable nail salon as recited in claim 5 wherein said base further comprises a wheel attached to the left and right sides.

7. The portable nail salon as recited in claim 6 wherein said left and right sides are joined at the top by a tube to form the handle.

* * * * *